US008029251B2

(12) United States Patent
Oguma

(10) Patent No.: US 8,029,251 B2
(45) Date of Patent: Oct. 4, 2011

(54) FAN HAVING CONICAL IMPELLER CUP

(75) Inventor: Yoshiaki Oguma, Kyoto (JP)

(73) Assignee: Nidec Corporation, Kyoto (JP)

( * ) Notice: Subject to any disclaimer, the term of this patent is extended or adjusted under 35 U.S.C. 154(b) by 1056 days.

(21) Appl. No.: 11/854,011

(22) Filed: Sep. 12, 2007

(65) Prior Publication Data

US 2008/0063542 A1 Mar. 13, 2008

(30) Foreign Application Priority Data

Sep. 12, 2006 (JP) ..... 2006-247372

(51) Int. Cl.
*F04B 35/04* (2006.01)
*F01D 1/00* (2006.01)
*B63H 1/28* (2006.01)

(52) U.S. Cl. ..... 417/354; 415/219.1; 416/244 R

(58) Field of Classification Search ..... 417/354; 415/219.1, 220; 416/244.1
See application file for complete search history.

(56) References Cited

U.S. PATENT DOCUMENTS 4,832,576 A * 5/1989 Deguchi et al. ..... 417/45
5,695,318 A * 12/1997 Harmsen ..... 415/218.1
6,997,678 B2 * 2/2006 Sun ..... 415/211.2
7,112,906 B2 * 9/2006 Chou et al. ..... 310/156.12
2006/0280623 A1 * 12/2006 Yu et al. ..... 417/354

FOREIGN PATENT DOCUMENTS

| | | | |
|---|---|---|---|
| JP | 10-108435 | A | 4/1998 |
| JP | 2000-352397 | A | 12/2000 |
| JP | 2001-065497 | A | 3/2001 |
| JP | 2002-171716 | A | 6/2002 |
| JP | 2004-116291 | A | 4/2004 |

* cited by examiner

*Primary Examiner* — Charles Freay

(74) *Attorney, Agent, or Firm* — Keating & Bennett, LLP

(57) ABSTRACT

A fan for generating an air flow by rotating an impeller with a motor is provided. A cylindrical outer side surface of a rotor of the motor is press-fitted to an inner side surface of the impeller cup which is substantially cylindrical. An outer side surface of the impeller cup is a portion of a circular conical surface, thereby increasing the amount of air generated and transmitted by the fan. A gap is formed between the outer side surface and the inner cylindrical surface of the impeller cup. The cylindrical outer side surface of the rotor is connected to the inside of the inner cylindrical surface of the impeller cup coaxially with each other. Thus, the impeller and the rotor can be reliably fixed to each other with improved performance of transmitting air.

17 Claims, 7 Drawing Sheets

FAN HAVING CONICAL IMPELLER CUP

BACKGROUND OF THE INVENTION

1. Field of the Invention

The present invention relates to a fan for generating an air flow, in which a rotor of a motor is arranged in an impeller cup.

2. Description of the Related Art

Electronic devices such as personal computers are equipped with fans for generating air flow in order to minimize the temperature increase in the electronic devices. The air is used for cooling a particular component and/or discharging heats generated in the electronic devices.

Those fans usually generate an air flow by rotating an impeller having a plurality of blades on its outer side surface with a rotational force generated by a motor. In most of those fans, a rotor of the motor is arranged inside an impeller cup of the impeller.

The structure of the typical fan is described in more detail. The impeller of the fan includes the impeller cup which is generally cylindrical. The blades are arranged outside the impeller cup in a circumferential direction of the impeller cup. Inside the impeller cup is arranged the motor. The motor mainly includes: a rotor yoke which is cylindrical; a cylindrical rotor magnet attached to an inner side surface of the rotor yoke; and a stator arranged inside the rotor yoke to oppose the rotor magnet. The rotor yoke is supported in a rotatable manner relative to the stator. When power is supplied to coil windings of the stator, a magnetic field generated by the stator interacts with magnetic poles of the rotor magnet, thereby generating a rotational force which rotates the rotor magnet relative to the stator. The rotor magnet rotates together with the rotor yoke about a center axis of the motor. The rotor yoke and the rotor magnet form together a rotor portion which is fitted at its outer side surface to the inner side surface of the impeller cup coaxially with each other. That is, the rotor yoke is fitted to the inner surface of the impeller cup. With this configuration, the impeller rotates together with the rotor yoke with the rotational force generated by the motor, i.e., the force rotating the rotor yoke about the center axis. The blades of the impeller are turned about the center axis by the rotation of the impeller so as to generate an air flow which is used for cooling the inside of the electronic devices.

Improvement of the cooling performance of fans for use in electronic devices has been demanded recently in order to cool the inside of the electronic devices more efficiently. This demand is met by increasing the discharged amount of hot air from the inside of the casing of the electronic devices to the outside, for example. One exemplary technique for achieving this is to increase the amount of air being transmitted from fans.

When a surrounding wall of the impeller cup of the fan is arranged so as to move away from its center axis from an air-inlet side of the fan to an air-outlet side, i.e., the impeller cup is formed such that its outer diameter increases toward the air-outlet side, for example, air intake resistance is reduced. Thus, the amount of air transmitted from the fan is increased. In this case, however, a fastening force of the impeller cup applied to the rotor yoke when the rotor yoke is press-fitted to the inside of the impeller cup may be insufficient. More specifically, since the rotor yoke usually has a cylindrical outer side surface, the fastening force of the impeller cup acts in a direction that is generally perpendicular to the surrounding wall of the impeller cup which is at an angle to the center axis. Therefore, a radial component, i.e., a component in a radial direction that is perpendicular to the center axis, which is required for fastening the rotor yoke, may be insufficient. The radial component of the fastening force can be increased by reducing the inner diameter of the surrounding wall of the impeller cup. However, in this case, stress beyond design limitations is applied to the surrounding wall when the rotor yoke is press-fitted to the impeller cup, causing deformation or breakage of the impeller cup.

SUMMARY OF THE INVENTION

According to a preferred embodiment of the present invention, a fan includes an impeller and a motor rotating the impeller. The impeller includes: an impeller cup having a generally cylindrical surrounding wall about an axis; and a plurality of blades integral with the impeller cup and arranged outside the surrounding wall in a radial direction that is perpendicular or substantially perpendicular to the axis. The surrounding wall has an outer surface defining a portion of a circular conical surface about the axis and has an outer diameter increasing from one side to the other side in an axial direction that is parallel or substantially parallel to the axis. An inner surface of the surrounding wall is cylindrical or substantially cylindrical about the axis. A gap is formed between the outer surface and the inner surface of the surrounding wall. The gap is opened toward the other side in the axial direction. Inside the inner surface of the surrounding wall of the impeller cup is arranged a rotor of the motor. The rotor is connected at its cylindrical outer side surface to the inner surface of the surrounding wall coaxially with each other.

As described above, the impeller cup has the outer side surface defining a portion of a circular cone and its outer diameter increases from an air-inlet side of the fan to an air-outlet side. Therefore, air intake resistance is reduced, thus increasing the amount of air transmitted by the fan. The inner side surface of the impeller cup is cylindrical unlike the outer surface thereof, and the gap is formed between the inner side surface and the outer side surface of the impeller cup. Thus, when an outer side surface of the rotor is fitted to the inner side surface of the impeller cup, a fitting force cannot be applied to the outer side surface of the impeller cup because it is shut out by the gap. This means that fastening force of the impeller cup applied to the rotor is not affected by the outer side surface of the impeller cup which forms a portion of a circular cone. That is, the fastening force of the impeller cup has nothing to do with the shape of the outer side surface of the impeller cup. Accordingly, reduction in a radial component of the fastening force can be prevented unlike the conventional fans. The impeller cup and the rotor can be reliably fitted to each other with a sufficient level of fastening force.

A plurality of elongated projections may be formed on the inner side surface of the impeller cup, which project inwardly from the inner side surface of the impeller cup in the radial direction and extend along the axial direction. The outer side surface of the rotor, which is cylindrical or substantially cylindrical, is connected to the inner side surface of the impeller cup while being pressed against and in contact with radially innermost portions of the elongated projections.

Moreover, a plurality of ribs may be provided in the gap between the outer side surface and the inner side surface of the impeller cup regularly in a circumferential direction of the impeller cup.

Other features, elements, advantages and characteristics of the present invention will become more apparent from the following detailed description of preferred embodiments thereof with reference to the attached drawings.

DETAILED DESCRIPTION OF PREFERRED EMBODIMENTS

Figure 1:
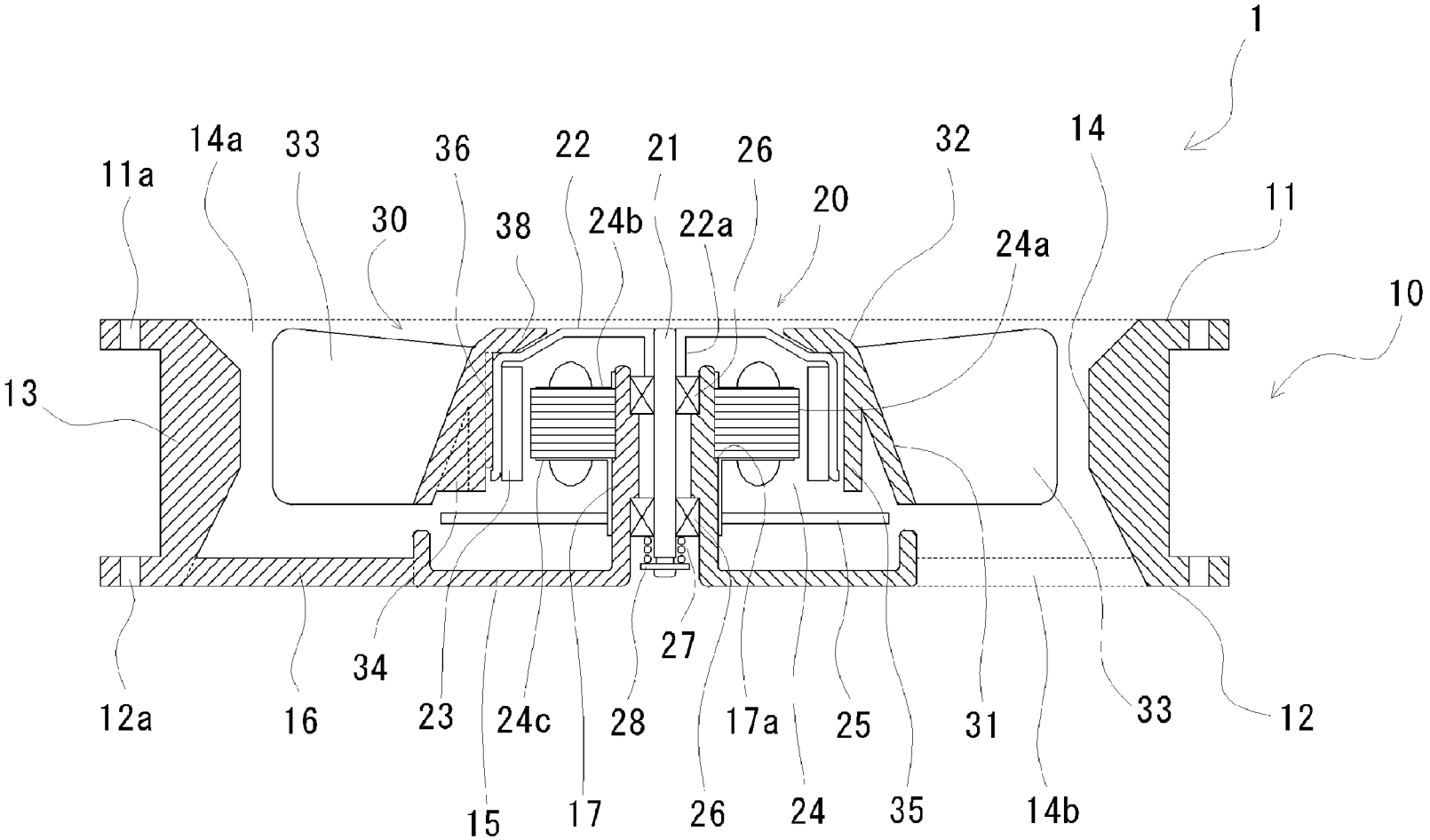
FIG. 1 is a cross-sectional view of a fan according to a first preferred embodiment of the present invention, taken along its center axis.

Referring to FIGS. 1 through 7, preferred embodiments of the present invention will be described in detail. It should be noted that in the explanation of preferred embodiments of the present invention, when positional relationships among and orientations of the different components are described as being up/down or left/right, ultimately positional relationships and orientations that are in the drawings are indicated; positional relationships among and orientations of the components once having been assembled into an actual device are not indicated. Meanwhile, in the following description, an axial direction indicates a direction parallel to a center axis of a fan, and a radial direction indicates a direction perpendicular to the center axis.

Figure 2:
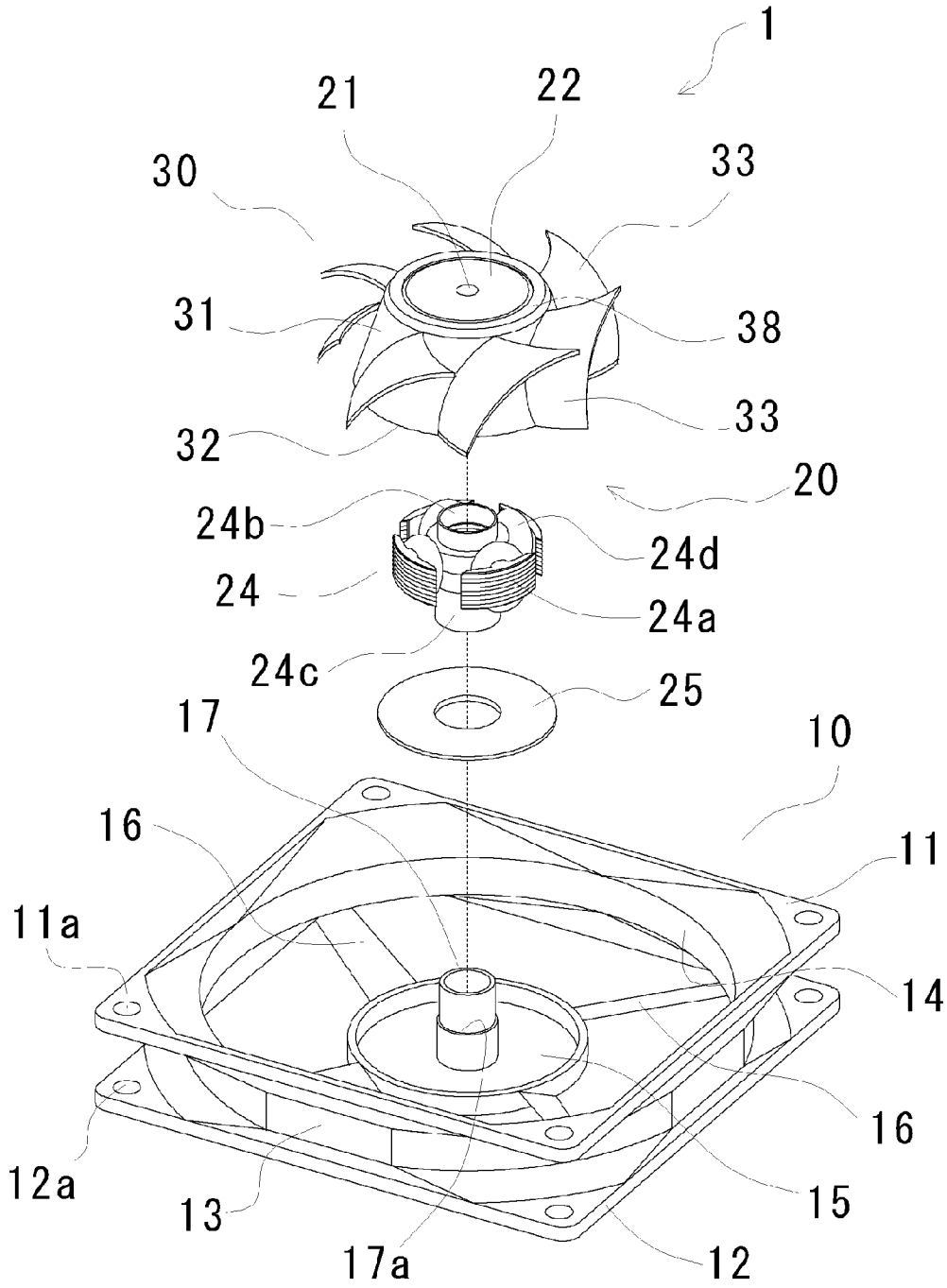
FIG. 2 is an exploded view of the fan of FIG. 1.
Figure 3:
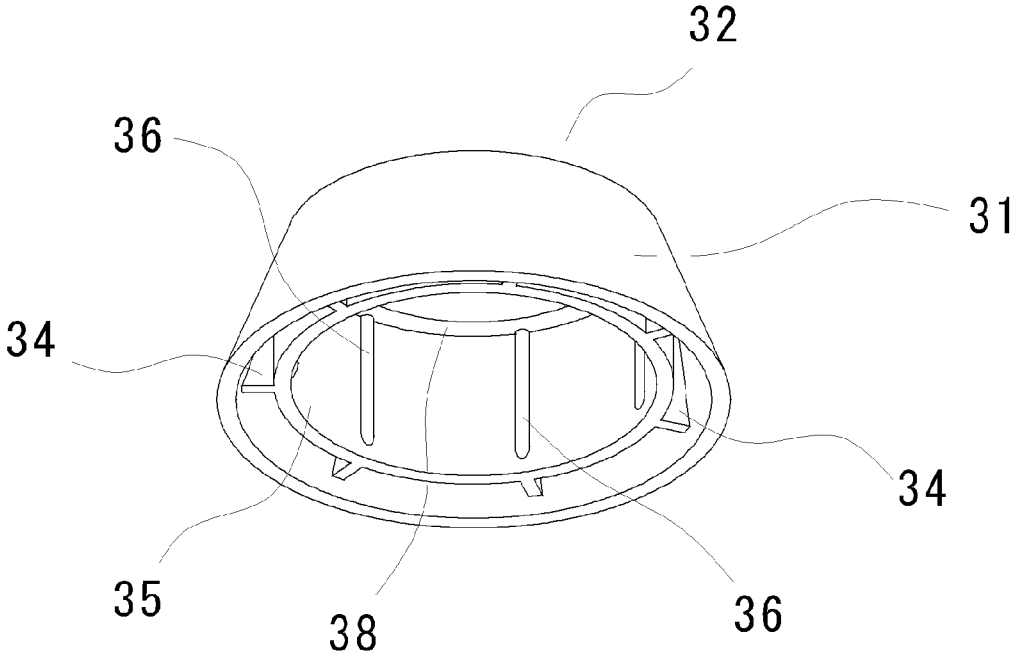
FIG. 3 is a perspective view of an impeller cup of the fan of FIG. 1.
Figure 4:
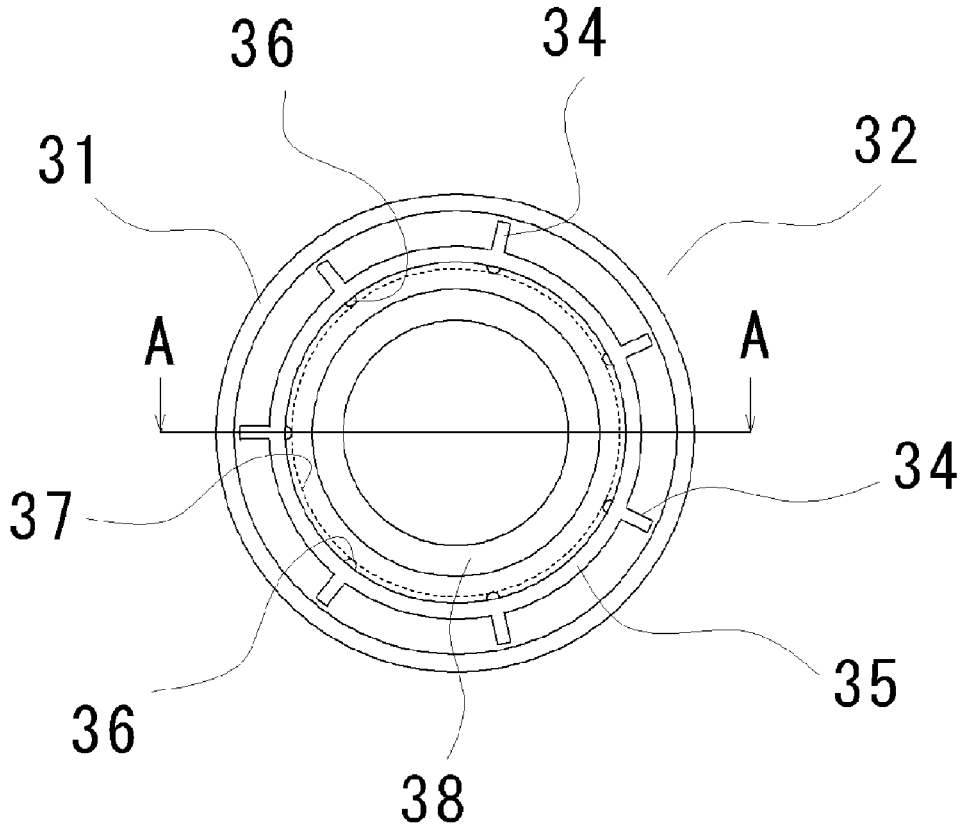
FIG. 4 is a bottom view of the impeller cup of FIG. 3.

FIG. 1 is a cross-sectional view of a fan 1 according to a preferred embodiment of the present invention. The fan 1 is an axial fan in this preferred embodiment. FIG. 2 is an exploded view of the fan 1. A housing 10, defining an outer frame of the fan 1, includes a pair of generally square frame members 11 and 12 and a cylindrical member 13 connecting the frame members 11 and 12 to each other. An inner circumferential surface of the cylindrical member 13 defines an air passage 14 surrounding an impeller detailed later. In this preferred embodiment, an upper opening of the air passage 14 serves as an air inlet 14*a*, and a lower opening serves as an air outlet 14*b*. The frame members 11 and 12 have attachment holes 11*a*, and 12*a*, at four corners, respectively. The attachment holes 11*a*, and 12*a* are used when the fan 1 is attached to an electronic device, for example. The housing 10 is preferably made of resin.

At a center of a lower end (i.e., the air-outlet 14*b* side end) of the housing 10 is arranged a circular base portion 15 which is supported by the lower frame member 12 with four arms 16. That is, the base portion 15 is integral with the housing 10. A cylindrical bearing housing 17 is arranged at a center of the base portion 15 so as to extend from the base portion 15 axially upward. The housing 10, the four arms 16, the base portion 15, and the bearing housing 17 are preferably made of resin integrally with each other, for example.

The base portion 15 defines a supporting board for supporting a motor 20. The motor 20 includes a rotor portion, a stator 24 fixed to the bearing housing 17, and a generally annular circuit board 25 arranged axially below the stator 24. The rotor portion includes a shaft 21 centered on a center axis of the fan 1 as a center of rotation, a cylindrical rotor yoke 22 having a cover, and a cylindrical rotor magnet 23 attached to an inner circumferential surface of the rotor yoke 22. The rotor yoke 22 is attached to an end of the shaft 21 to be rotatable together with the shaft 21 as one unit and coaxial therewith. For example, the rotor yoke 22 is preferably formed from a steel plate by plastic forming, e.g., pressing. An example of the steel plate is a rust-proof magnetically conductive plate such as a stainless plate. The cover of the rotor yoke 22 is provided with a boss 22*a*, formed at its center by drawing, for example. One end of the shaft 21 is press-fitted to the boss 22*a*. In this manner, the shaft 21 is connected to the rotor yoke 22, thereby serving as a center of rotation of the rotor. The rotor magnet 22 is magnetized such that different magnetic poles are alternately arranged in a circumferential direction of the rotor magnet 22.

The shaft 21 of the rotor portion is inserted from another end thereof, i.e., an end opposite to the end connected to the boss 22*a*, into the bearing housing 17. Inside the bearing housing 17, the shaft 21 is supported in a rotatable manner by a pair of bearings 26 provided in the bearing housing 17. The bearing 26 may be a ball bearing. Alternatively, at least one bearing having a sintered sleeve may be used in place of the pair of bearings 26. A coil spring 27 and a washer 28 are attached to a portion of the shaft 21 projecting from the lower bearing 26. Thus, removal of the shaft 21 from the bearing housing 17 can be prevented and the rotor portion can be retained at an appropriate axial position with respect to the bearing housing 17.

The stator 24 has an annular stator core stack 24*a* having a plurality of magnetic teeth extending outward in the radial direction of the stator core stack 24*a*. The stator core stack 24*a*, is formed by stacking a plurality of magnetically conductive steel plates. In this preferred embodiment, the stator core stack 24*a*, preferably has four teeth, for example. The stator 24 also includes a pair of insulators 24*b*, and 24*c* attached to the stator core stack 24*a*, from both sides of the stator core stack 24*a*, in the axial direction. The insulators 24*b*, and 24*c*, are preferably made of insulating resin, for example, and cover the stator core stack 24*a*, except for a radially outer surface of each magnetic tooth. The stator 24 further includes coil windings 24*d*, arranged around the respective magnetic teeth with the insulators 24*b*, and 24*c* interposed therebetween. In this preferred embodiment, the coil windings 24*d*, of two phases are provided. The stator 24 is fitted to the outer surface of the bearing housing 17 such that each magnetic tooth is radially opposed to the inner circumferential surface of the rotor magnet 23 with a gap interposed therebetween.

The outer surface of the bearing housing 17 has an annular step 17*a*, at the center in the axial direction. Thus, an outer diameter of the bearing housing 17 is different between upper and lower sides of the step 17*a*. When the stator 24 is fitted to the bearing housing 17, the stator core stack 24*a*, is brought into contact with the step 17*a*. That is, the stator core stack 24 is positioned by the bearing housing 17.

On the circuit board 25, various electronic components for controlling power supply to the coil windings 24*d*, are mounted to define a motor control circuit. The circuit board 25 is fitted to and supported by a cylindrical portion of the lower insulator 24*c*. The coil windings 24*d*, of the stator 24 are electrically connected to terminals on the circuit board 25. The circuit board 25 is arranged between the base portion 15 and the stator 24 already attached to the bearing housing 17.

An impeller 30 rotated by the motor 20 is accommodated in the housing 10. The impeller 30 includes an impeller cup 32 which is cylindrical or substantially cylindrical. Hereinafter, the cylindrical side wall of the impeller cup 32 is referred to as a surrounding wall 31. The surrounding wall 31 surrounds and covers the outer surface of the rotor yoke 22 and is attached to the rotor yoke 22. The impeller 30 also includes a plurality of blades 33 extending from the surrounding wall 31 of the impeller cup 32 outward in the radial direction. In this preferred embodiment, the impeller 30 preferably has seven blades 33, for example. The blades 33 are integrally formed with one another by, for example, injection molding of resin. The blades 33 are regularly arranged in the circumferential direction of the impeller cup 32.

FIGS. 3 to 7 show the details of the impeller cup 32. The surrounding wall 31 of the impeller cup 32 preferably has a generally truncated conical shape. An outer diameter of the surrounding wall 31 increases as it moves from the air-inlet side of the fan 1 to the air-outlet side. This structure reduces air intake resistance, thereby increasing the amount of air transmitted from the fan 1. In this preferred embodiment, an inner surface of the surrounding wall 31 is also at an angle to the axial direction. On the inner surface of the surrounding wall 31, a plurality of axially elongated ribs 34 are arranged regularly in the circumferential direction of the impeller cup 32. The ribs 34 project radially inwardly from the surrounding wall 31. The radial dimension of each rib 34 gradually increases as it moves from the air-inlet side of the fan 1 to the air-outlet side, in accordance with the shape of the surrounding wall 31. Radially inner ends of the ribs 34 extend substantially parallel to the center axis.

Inside the surrounding wall 31 of the impeller cup 32, an annular member 35 is arranged coaxially with the impeller cup 32. The annular member 35 preferably is cylindrical or substantially cylindrical about the center axis and connects the radially inner ends of the ribs 34 to one another. A gap is formed between the annular member 35 and the surrounding wall 31. The gap is opened axially downward and has a radial dimension increasing downward. That is, the ribs 34 are arranged in the gap. The annular member 35 has a plurality of axially elongated projections 36 on the inner surface thereof. The axially elongated projections 36 slightly project from the annular member 35 radially inwardly. In this preferred embodiment, the projections 36 are arranged regularly in the circumferential direction so as to be located at radially inner positions of the respective ribs 34. A radially inner surface of each projection 36 is curved. An envelope 37 of radially inner ends of the projections is a cylindrical surface. The diameter of the envelope 37 is slightly smaller than the outer diameter of the rotor yoke 22.

The impeller cup 32 has a top annular wall 38 at its upper end. The top annular wall 38 extends from an upper portion of the surrounding wall 31 inwardly in the radial direction. An inner periphery of the top annular wall 38 defines an opening 39.

The rotor yoke 22 of the rotor portion is inserted into the impeller cup 32. In this preferred embodiment, the surrounding wall of the rotor yoke 22 is press-fitted and fixed to the radially inner ends of the projections 36 inside the annular member 35 while being pressed against and in contact with the projections 36. When the rotor yoke 22 is inserted into the impeller cup 32, a top wall portion of the rotor yoke 22, which projects upward and defines a portion of a circular truncated cone, comes into contact with the top annular wall 38 of the impeller cup 32 at its outer periphery. In this state, the highest portion of the top wall portion of the rotor yoke 22 and the upper surface of the top annular wall 38 of the impeller cup 32 are located on the same level in the axial direction.

When the rotor yoke 22 is inserted into a space defined by the envelope 37 of the elongated projections 36 by press-fitting, radially outward stress is applied to the projections 36. Since the annular member 35 is disposed between the projections 36 and the ribs 34 to connect the projections 36 and the ribs 34 in the circumferential direction, the radial stress applied to the projections 36 when the rotor yoke 22 is press-fitted to the inside of the annular member 35 is absorbed by the annular member 35 as a circumferential force. Thus, the force radially acting on each rib 34 is reduced, resulting in reduction in a load applied to the surrounding wall 31 of the impeller cup 32. Consequently, the stress caused by dimensional errors of various components and applied in press-fitting can be absorbed by elasticity of the ribs 34 and projections 36, as compared with a case where the force of press-fitting is applied to the entire surface of the surrounding wall 31 of the impeller cup 32.

The outer surface of the surrounding wall 31 of the impeller cup 32 is at an angle to the axial direction such that it diverts away from the center axis as it moves toward the base portion 15, i.e., toward the air-outlet side of the fan 1. That is, the outer diameter of the impeller cup 32 increases as it moves toward the base portion 15. In this case, the fastening force of the impeller cup 32 that is applied to the rotor yoke 22 acts inwardly in a direction that is perpendicular or substantially perpendicular to the surrounding wall 31 of the impeller cup 32. Thus, the radial component of the fastening force applied to the rotor yoke 22 is small. On the other hand, in this preferred embodiment, the annular member 35 is provided between the surrounding wall 31 and the envelope 37 inside which the rotor yoke 22 is press-fitted and the annular member 35 is cylindrical or substantially cylindrical about the center axis. Therefore, stress applied to the rotor yoke 22 by contact between the annular member 35 and the rotor yoke 22 can compensate the radial component of the fastening force of the impeller cup 32. Accordingly, even if the outer surface of the surrounding wall of the impeller cup 32 is at an angle to the center axis, the rotor yoke 22 can be fastened reliably.

A lower end of each elongated projection 36 is rounded and is located slightly higher than a lower end of the annular member 35 in the axial direction. Thus, the rotor yoke 22 can be guided to the inside of the impeller cup 32, thereby allowing easy press-fitting of the rotor yoke 22.

In this preferred embodiment, the ribs 34 of the impeller cup 32 are preferably arranged on lines emerging from the projections 36 outwardly in the radial direction, respectively. Alternatively, the ribs 34 and the projections 36 may be arranged alternately in the circumferential direction of the impeller cup 32. In this case, stress applied to the projections 36 from the rotor yoke 22 in press-fitting of the rotor yoke 22 are sufficiently reduced by the annular member 35 and is then transmitted to the ribs 34.

In this preferred embodiment, the number of the ribs 34 is preferably equal to the number of the projections 36. However, the present invention is not limited thereto. When the number of the ribs 34 is larger than the number of the projections 36, for example, when the number of the ribs 34 is an integral multiple of the number of the projections 36, the number of points at which the surrounding wall 31 of the impeller cup 32 is connected to the annular member 35 with the ribs 34 is increased. Thus, the surrounding wall 31 can be reinforced more by the annular member 35. That is, the strength of the surrounding wall 31 can be enforced. To the contrary, when the number of the projections 36 is larger than the number of the ribs 34, for example, when the number of the projections 36 is an integral multiple of the number of the ribs 34, the fastening strength between the projections 36 and the rotor yoke 22 can be increased in accordance with the increase in the number of the projections 36.

As described above, the ribs 34 of the impeller cup 32 are arranged on the lines emerging from the projections 36 outwardly in the radial direction in this preferred embodiment. The positions of the ribs 34 correspond to the positions of the blades 33. In other words, the ribs 34 and the blades 33 are arranged at the same circumferential positions with respect to the center axis. In addition, at least the number of the ribs 34 and the number of the blades 33 are preferably the same as each other. This configuration is advantageous for manufacturing the impeller 30, as set forth below referring to FIGS. 5 to 7.

In this preferred embodiment, the impeller 30 is preferably made of resin by injection molding to include the impeller cup 32 and a plurality of blades 33 which are integral with the impeller cup 32. Resin injection molding is a well-known method in which molten resin is injected into a mold and is then cooled to obtain a molded product. The mold is generally formed by combining two mold pieces, e.g., an upper mold piece and a lower mold piece with each other.

Figure 5:
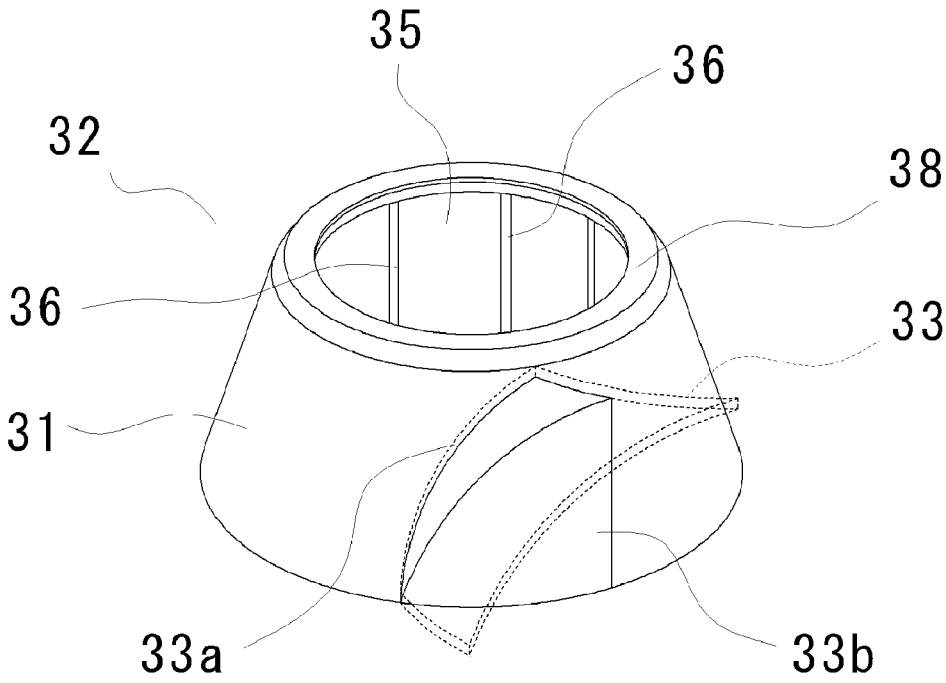
FIG. 5 is another perspective view of the impeller cup of FIG. 3.

FIG. 5 illustrates the positional relationship between the surrounding wall 31 of the impeller cup 32 and one of the blades 33. Each blade 33 is connected at its root portion 33*a* to the outer surface of the surrounding wall 31 of the impeller cup 32. On the outer surface of the surrounding wall 31, a base 33*b*, described later is provided adjacent to the root portion 33*a*. In FIG. 5, a portion of the blade 33 other than the root portion 33*a*, is shown with broken line.

With regard to the outer surface of the impeller 30, upper surfaces of the blades 33, portions of the outer surface of the surrounding wall 31 where no blade 33 exists in the axial direction, and portions of the outer surface of the surrounding wall 31 axially above the root portions 33*a*, of the respective blades 33 are formed by the upper mold piece when two axially separatable mold pieces are used in injection molding. On the other hand, the lower mold piece forms lower surfaces of portions of the blades 33 which are located radially outside the axially lower end of the surrounding wall 31 of the impeller cup 32. Since the surrounding wall 31 is at an angle to the center axis, i.e., the impeller cup 32 has an outer diameter increasing downward, portions of the outer surface of the surrounding wall 31 between the axially lower end thereof and the blades 33 are inevitably formed to be parallel to the center axis. Therefore, those portions become unavoidably thicker. Those portions are the bases 33*b*.

Figure 6:
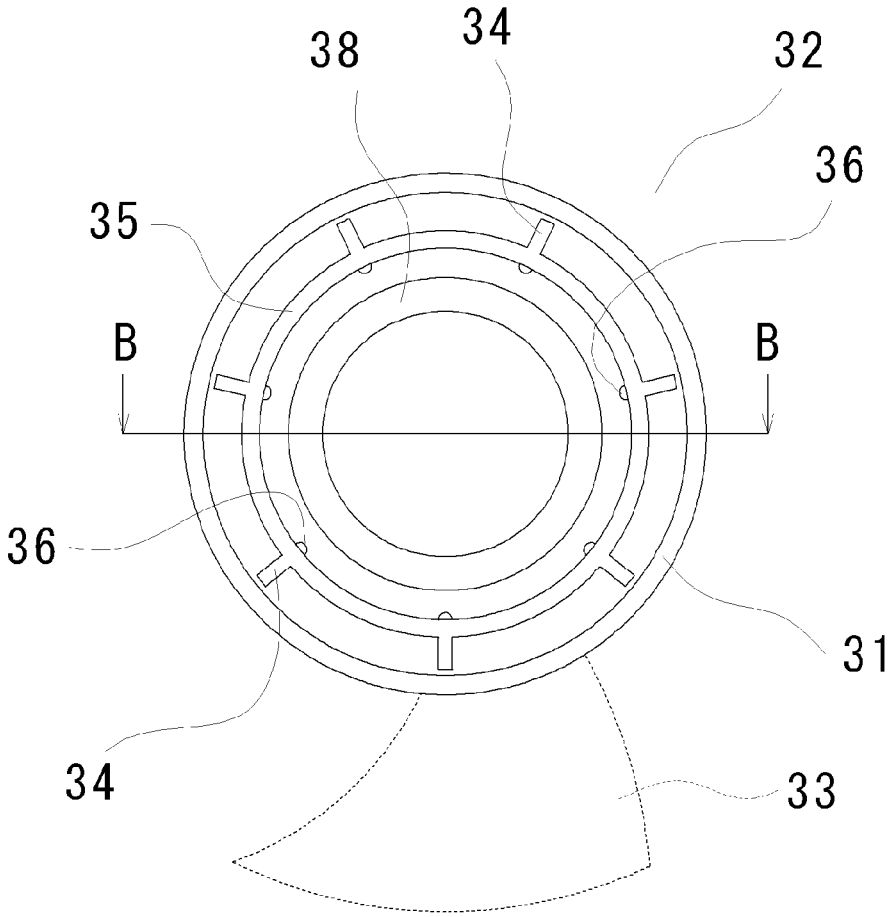
FIG. 6 is a bottom view of the impeller cup of FIG. 3, showing a different state from that in FIG. 4.
Figure 7:
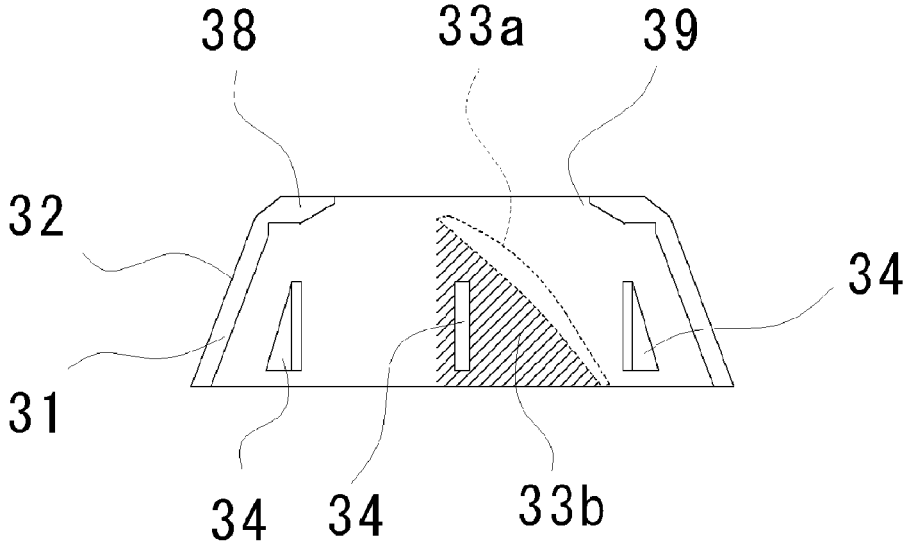
FIG. 7 is a cross-sectional view of the impeller cup of FIG. 6, taken along line B-B.

FIG. 6 is a bottom view of the impeller cup 32 of FIG. 5. FIG. 7 is a cross-sectional view of the impeller cup 32 taken along line B-B in FIG. 6. Please note that the annular member 35 and the projections 36 are omitted in FIG. 7. In FIG. 7, the base 33*b*, is formed outside the hatched portion of the outer side surface of the impeller cup 32 in the radial direction, and the root portion 33*a*, of the blade 33 is shown with broken line.

As is apparent from FIG. 7, the rib 34 is arranged on the inner surface of the surrounding wall 31 of the impeller cup 32 radially inside the base 33*b*. The base 33*b*, is thicker than other portions of the surrounding wall 31 for the aforementioned reason and therefore has the enhanced strength. Thus, stress of press-fitting of the rotor yoke 22 to the impeller cup 32, which is not only absorbed by the annular member 35 but is transferred to the surrounding wall 31 via the ribs 34, can be absorbed by the base 33*b*. This is because the rib 34 for transmitting the stress to the surrounding wall 31 is arranged radially inside the base 33*b*. Consequently, it is possible to reliably prevent deformation or breakage of the impeller cup 32 caused by the stress applied to the surrounding wall 31 of the impeller cup 32.

Although the axial fan is described in this preferred embodiment, the present invention can be applied to other types of fans for generating air flow, such as a centrifugal fan.

As described above, according to the preferred embodiments of the present invention, when a rotor of a motor is fitted and fixed to the inside of an impeller cup of an impeller in the form of a truncated circular cone, it is possible to both reduce stress applied to a surrounding wall of the impeller cup and obtain a sufficient level of fastening force of the impeller cup applied to the rotor. Therefore, the impeller and the rotor can be always fixed to each other firmly. Consequently, the amount of air transmitted by a fan including such an impeller cup can be reliably increased.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A fan comprising:

an impeller rotatable about an axis to generate an air flow; and a motor operable to rotate the impeller about the axis and including a rotor having a substantially cylindrical outer side surface; wherein the impeller includes an impeller cup including a surrounding wall which is substantially cylindrical about the axis and a plurality of blades integral with the impeller cup, the blades being arranged outside the surrounding wall of the impeller cup in a radial direction that is perpendicular or substantially perpendicular to the axis;

an outer surface of the surrounding wall of the impeller cup defines a portion of a truncated circular cone with an outer diameter of the surrounding wall increasing from a top side to a bottom side in an axial direction that is parallel or substantially parallel to the axis;

an inner substantially cylindrical surface about the axis is provided inside the surrounding wall with a gap interposed between the inner substantially cylindrical surface and the outer surface of the surrounding wall, the gap being opened toward the bottom side in the axial direction; the outer side surface of the rotor is connected to an inside of the inner substantially cylindrical surface of the impeller cup coaxially therewith;

the inner substantially cylindrical surface of the impeller cup includes a plurality of elongated projections which project inwardly in the radial direction, extend along the axial direction, and are circumferentially arranged about the impeller cup;

an outer substantially cylindrical surface of the impeller cup includes a plurality of ribs; and a total number of the plurality of blades, a total number of the plurality of elongated projections, and a total number of the plurality of ribs are each equal to each other, and the plurality of blades, the plurality of elongated projections, and the plurality of ribs are arranged at the same circumferential positions such that respective ones of the plurality of blades, the plurality of elongated projections, and the plurality of ribs are aligned with each other in the radial direction.

2. A fan according to claim 1, wherein a size of the gap in the radial direction decreases from the bottom side to the top side in the axial direction.

3. A fan according to claim 2, wherein the gap is annularly arranged about the axis.

4. A fan according to claim 3, wherein the plurality of ribs are arranged substantially equally apart from one another in a circumferential direction of the impeller cup.

5. A fan according to claim 4, wherein the plurality of blades are axial fan blades.

6. A fan according to claim 1, wherein the substantially cylindrical outer side surface of the rotor is pressed against and in contact with radially innermost portions of the plurality of elongated projections.

7. A fan according to claim 6, wherein the gap is arranged generally annularly about the axis, and the plurality of ribs are arranged substantially equally apart from one another in a circumferential direction of the impeller cup.

8. A fan according to claim 7, wherein an axial length of the plurality of ribs is greater than an axial length of the plurality of elongated projections.

9. A fan according to claim 4, wherein the impeller cup includes a base portion that is thicker than other portions of the surrounding wall, the base portion being arranged radially outward from the plurality of ribs at a position where the base portion and the plurality of ribs are aligned in the radial direction.

10. A fan comprising:

an impeller rotatable about an axis to generate an air flow; and a motor operable to rotate the impeller and including a rotor having a substantially cylindrical outer side surface; wherein the impeller includes an impeller cup having a substantially circular conical surface about the axis and a plurality of blades integral with the impeller cup and arranged outside the substantially circular conical surface in a radial direction that is perpendicular or substantially perpendicular to the axis, an outer diameter of the substantially circular conical surface increasing from a top side in an axial direction that is parallel or substantially parallel to the axis to a bottom side; wherein the impeller cup includes:

an annular surrounding wall including the substantially circular conical surface as its outer surface; and an annular member arranged inside the surrounding wall with a gap interposed therebetween, the annular member having an inner substantially cylindrical surface about the axis, the gap being opened toward the bottom side in the axial direction;

the cylindrical outer side surface of the rotor is connected to an inside of the inner substantially cylindrical surface of the annular member of the impeller cup coaxially with each other;

the inner substantially cylindrical surface of the impeller cup includes a plurality of elongated projections which project inwardly in the radial direction, extend along the axial direction, and are circumferentially arranged about the impeller cup;

an outer substantially cylindrical surface of the impeller cup includes a plurality of ribs; and a total number of the plurality of blades, a total number of the plurality of elongated projections, and a total number of the plurality of ribs are each equal to each other, and the plurality of blades, the plurality of elongated projections, and the plurality of ribs are arranged at the same circumferential positions such that respective ones of the plurality of blades, the plurality of elongated projections, and the plurality of ribs are aligned with each other in the radial direction.

11. A fan according to claim 10, wherein the surrounding wall and the annular member of the impeller cup have approximately the same thickness and are connected to each other at axial ends thereof so as to be integral with each other.

12. A fan according to claim 10, wherein the substantially cylindrical outer surface of the rotor is pressed against and is in contact with radially innermost portions of the plurality of elongated projections.

13. A fan according to claim 10, wherein the plurality of ribs extend in the radial direction and are arranged substantially equally apart from one another in a circumferential direction of the impeller cup.

14. A fan according to claim 13, wherein the substantially cylindrical outer surface of the rotor is pressed against and is in contact with radially innermost portions of the plurality of elongated projections.

15. A fan according to claim 10, wherein the blades of the impeller cup generate an axial air flow and are arranged equally apart from one another in the circumferential direction of the impeller cup.

16. A fan according to claim 10, wherein an axial length of the plurality of ribs is greater than an axial length of the plurality of elongated projections.

17. A fan according to claim 13, wherein the impeller cup includes a base portion that is thicker than other portions of the surrounding wall, the base portion being arranged radially outward from the plurality of ribs at a position where the base portion and the plurality of ribs are aligned in the radial direction.

* * * * *